US005660939A

United States Patent [19]

Burdett

[11] Patent Number: 5,660,939

[45] Date of Patent: Aug. 26, 1997

[54] STAINLESS STEEL ALLOY

[75] Inventor: William B. Burdett, Derbyshire, England

[73] Assignee: Rolls-Royce and Associates Limited, Derby, England

[21] Appl. No.: 608,119

[22] Filed: Feb. 28, 1996

[30] Foreign Application Priority Data

Mar. 31, 1995 [GB] United Kingdom ..... 9506677

[51] Int. Cl.[6] ..... C22C 38/34; C22C 38/48; C22C 35/50; C22C 38/56

[52] U.S. Cl. ..... 428/685; 420/11; 420/54; 420/118; 376/900; 75/246

[58] Field of Search ..... 75/228, 230, 246; 420/8, 9, 10, 11, 34, 43, 50, 51, 54, 55, 56, 70, 94, 97, 98, 99, 100, 117, 118, 119, 126, 127; 428/655, 544, 681, 668, 684, 685; 376/900

[56] References Cited

U.S. PATENT DOCUMENTS

| | | | |
|---|---|---|---|
| 4,158,606 | 6/1979 | Bloom et al. | 176/87 |
| 4,487,630 | 12/1984 | Crock | 75/123 B |
| 4,582,536 | 4/1986 | Raybould | 75/246 |
| 4,643,767 | 2/1987 | Crook et al. | 420/12 |
| 4,720,435 | 1/1988 | Crook et al. | 428/677 |
| 5,133,815 | 7/1992 | Hashimoto et al. | 148/319 |
| 5,244,513 | 9/1993 | Kadoya et al. | 148/402 |
| 5,296,054 | 3/1994 | Lvovich et al. | 148/327 |

FOREIGN PATENT DOCUMENTS 2167088 5/1986 United Kingdom .

OTHER PUBLICATIONS

Crook et al, "New Alloys Resistant to Sliding Wear and Cavitation Erosion", Surfacing Journal, vol. 16, No. 2, 1985, pp. 35–39 no month available.

Patent Abstracts of Japan, vol. 018, No. 498 (M–1675), Sep. 1994 re JP–A–06 170584.

Crook et al, "New Alloy Resistant to Galling", Elsevier Science Publishers (Conference) 1985, pp. 1–5 no month available.

*Primary Examiner*—John Zimmerman
*Assistant Examiner*—Michael LaVilla
*Attorney, Agent, or Firm*—Cushman Darby & Cushman IP Group of Pillsbury Madison & Sutro LLP

[57] ABSTRACT

A chromium nickel silicon stainless steel alloy with improved wear resistance consists of, in weight percent, 19 to 22 chromium, 8.5 to 10.5 nickel, 5.25 to 5.75 silicon, 1.7 to 2.0 carbon, 8.0 to 9.0 niobium, 0.3 to 0.5 titanium and the balance iron plus impurities. The addition of titanium and increased amounts of niobium and silicon alter the microstructure of the stainless steel to form a duplex austenitic/ferritic microstructure which undergoes secondary hardening due to the formation of an iron silicon intermetallic phase.

7 Claims, No Drawings

STAINLESS STEEL ALLOY

FIELD OF THE INVENTION

The present invention relates to a stainless steel alloy and in particular relates to a chromium nickel silicon stainless steel alloy that is especially suited for use as components in nuclear reactors, particularly in the components used in the steam generating plant of nuclear reactors.

BACKGROUND OF THE INVENTION

Currently cobalt based alloys are used in the steam generating plant of nuclear reactors, but cobalt has a long half life making the use of cobalt undesirable for use in such applications. Some known iron base alloys have good wear properties, but insufficient corrosion resistance. Some known nickel base alloys have good corrosion resistance but poor wear resistance.

One known stainless steel potentially suitable for use in components of nuclear reactors is disclosed in UK patent 2167088, and this comprises broadly speaking 15 to less than 25 wt % chromium, 5 to 15 wt % nickel, 2.7 to 5.5 wt % silicon, 1 to 3 wt % carbon, 5 to 15 wt % niobium plus vanadium, up to 0.15 wt % nitrogen, up to 1.5 wt % cobalt and the balance iron plus impurities. This alloy contains very little or no cobalt thus having a low half life.

The particular stainless steel alloy available commercially from Deloro Stellite, St Louis, Mo. USA under the trade name Tristelle 5183, comprises in weight percent 19–22 chromium, 8.5 to 10.5 nickel, 4.5 to 5.5 silicon, 6.5 to 7.5 niobium, 1.8 to 2.2 carbon, up to 0.1 nitrogen and balance iron plus impurities.

The alloys suitable for use in steam generating plant of nuclear reactors must have high wear resistance and high corrosion resistance. The alloys disclosed in UK patent 2167088 have been tested and it has been found that they have a hardness of 350–450 Vickers (38–44 Rockwell C performed on a Rockwell hardness testing machine).

SUMMARY OF THE INVENTION

The present invention seeks to provide a stainless steel alloy suitable for use in nuclear reactors which has greater hardness than the known stainless steel alloys.

Accordingly, the present invention provides a stainless steel alloy consisting of, in weight percent, 15 to 25 chromium, 5 to 15 nickel, 2.7 to 6.0 silicon, 1 to 3 carbon, 5 to 15 niobium, 0.3 to 0.5 titanium and the balance iron plus impurities.

The most preferred stainless steel alloy consists of, in weight percent, 19 to 22 chromium, 8.5 to 10.5 nickel, 5.25 to 5.75 silicon, 1.7 to 2.0 carbon, 8.0 to 9.0 niobium, 0.3 to 0.5 titanium and the balance iron plus impurities.

Preferably the alloy is hot isostatically pressed.

The alloy may be used for making article or components or may be used for coating articles or components.

DETAILED DESCRIPTION OF THE INVENTION

The present invention will be more fully described by way of reference to the following example.

The basic commercially available stainless steel sold under the trade name Tristelle 5183 was modified principally by the deliberate addition of titanium to the stainless steel alloy, and further modified by increasing the amounts of niobium and silicon present in the stainless steel alloy. In particular the titanium was added such that the stainless steel alloy consisted of 0.3 to 0.5 weight percent titanium, the niobium was increased such that the stainless steel alloy consisted of 8.0 to 9.0 weight percent niobium and the silicon was increased such that the stainless steel alloy consisted of 5.25 to 5.75 weight percent silicon.

These controlled additions of titanium, niobium and silicon alter the structure of the stainless steel compared to that in the commercially available Tristelle 5183. The additions of titanium, niobium and silicon produce a duplex auszenitic/ferritic microstructure which undergoes secondary hardening due to the formation of an iron silicon intermetallic phase which has been identified by electron transmission spectroscopy. Further hardening as achievable by hot isostatic pressing (HIPPING) of the stainless steel alloy in powder form. The stainless steel alloy of the present invention creates a duplex microstructure within which secondary hardening occurs. The secondary hardening only occurs in the ferrite phase.

The actual stainless steel alloy consists of, in weight percent, 19–22 chromium, 8.5 to 10.5 nickel, 5.25 to 5.75 silicon, 1.7 to 2.0 carbon, 8.0 to 9.0 niobium, 0.3 to 0.5 titanium and the balance iron plus incidental impurities. The impurities may be up to 0.2 weight % cobalt, up to 0.5 weight % manganese, up to 0.3 weight % molybdenum, up to 0.03 weight % phosphor, up to 0.03 weight % sulphur, and up to 0.1 weight % nitrogen.

The stainless steel alloy of the present invention has been prepared and tested and it has been found that it has a hardness of 475–525 Vickers. Thus it can be seen that the stainless steel alloy of the present invention is considerably harder than those of the prior art, making the stainless steel alloys of the present invention more suitable for use in nuclear reactor steam generating plant, or other applications where high wear resistance is required.

The additions of titanium, niobium and silicon may also be applied to the broad stainless steel alloy range of UK patent no 2167088. The stainless steel alloy of the present invention may be used in the form of cast articles or components, in weldings or hard facing materials applied to articles or components, in wrought articles or components or in powder metallurgy articles or components.

I claim:

1. A stainless steel alloy consisting essentially of 19 to 22 percent by weight chromium, 8.5 to 10.5 percent by weight nickel, 5.25 to 5.75 percent by weight silicon, 1.7 to 2.0 percent by weight carbon, 8.0 to 9.0 percent by weight niobium, 0.3 to 0.5 percent by weight titanium and the balance iron.

2. A stainless steel alloy as claimed in claim 1 wherein the alloy has been hot isostatically pressed.

3. An article comprising a stainless steel alloy as claimed in claim 1.

4. An article having a coating comprising a stainless steel alloy as claimed in claim 1.

5. An article as claimed in claim 3 wherein the article is selected from the group comprising a cast article, a wrought article and a powder metallurgy article.

6. An article as claimed in claim 4 wherein the coating is selected from the group comprising a hard facing and a welding.

7. A steam generating plant having at least one component comprising a wear resistant stainless steel consisting essentially of 19 to 22 percent by weight chromium, 8.5 to 10.5 percent by weight nickel, 5.25 to 5.75 percent by weight silicon, 1.7 to 2.0 percent by weight carbon, 8.0 to 9.0 percent by weight niobium, 0.3 to 0.5 percent by weight titanium and the balance iron.

* * * * *